US006854833B2

(12) United States Patent
Ito

(10) Patent No.: US 6,854,833 B2
(45) Date of Patent: Feb. 15, 2005

(54) INK-JET HEAD AND MANUFACTURING METHOD OF THE SAME

(75) Inventor: Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 83 days.

(21) Appl. No.: 10/438,098

(22) Filed: May 15, 2003

(65) Prior Publication Data

US 2003/0218658 A1 Nov. 27, 2003

(30) Foreign Application Priority Data

May 21, 2002 (JP) ..... 2002-146244

(51) Int. Cl.[7] ..... B41J 2/045
(52) U.S. Cl. ..... 347/68
(58) Field of Search ..... 347/65, 68, 71; 29/890.1

(56) References Cited

U.S. PATENT DOCUMENTS 5,646,658 A 7/1997 Thiel et al.
5,818,478 A 10/1998 Gibson
6,439,686 B2 * 8/2002 Glass ..... 347/40
6,443,564 B1 * 9/2002 Keil et al. ..... 347/65
2001/0024221 A1 9/2001 Tanaka et al.

FOREIGN PATENT DOCUMENTS

EP 0 670 222 A2 9/1995
JP A 55-084678 6/1980

* cited by examiner

*Primary Examiner*—Thinh Nguyen
(74) *Attorney, Agent, or Firm*—Oliff & Berridge, PLC

(57) ABSTRACT

An ink-jet head comprises a passage unit including pressure chambers each connected to a nozzle, and an actuator unit bonded to the passage unit. The actuator unit includes active portions for changing volumes of the respective pressure chambers. Kinds of passage units different in positions of pressure chambers distant from a reference position set on a face of each passage unit, are prepared for a single kind of actuator units fabricated in the same design shape with a positional difference between corresponding pressure chambers in the different kinds of passage units increasing as a distance of the pressure chambers from the reference position increases.

17 Claims, 11 Drawing Sheets

INK-JET HEAD AND MANUFACTURING METHOD OF THE SAME

BACKGROUND OF THE INVENTION

1. Field of the Invention

The present invention relates to an ink-jet head for ejecting droplets of ink onto a print surface to make an image on the print surface, and a manufacturing method of the ink-jet head.

2. Description of Related Art

An ink-jet head is known in which an actuator unit is bonded to a passage unit. The passage unit includes therein pressure chambers each connected to a nozzle. The actuator unit includes therein active portions for changing the volumes of the respective pressure chambers. In the ink-jet head, in many cases, the actuator unit includes a piezoelectric ceramic sheet portions of which sandwiched by electrodes function as the respective active portions. When a portion of the polarized piezoelectric ceramic sheet sandwiched by electrodes receives, through the electrodes, an electric field along the polarization, the portion of the piezoelectric ceramic sheet is extended or contracted along the thickness of the sheet. Thereby, the volume of the pressure chamber corresponding to the active portion is changed to eject ink through the nozzle connected to the corresponding pressure chamber.

Such piezoelectric ceramic sheets are made through baking process, and thus green sheets to be baked are prepared with taking account of shrinkage upon baking. However, the shrinkage varies in quantity from sheet to sheet. In many cases, therefore, the finished size of a piezoelectric ceramic sheet may be larger or smaller than the design size, i.e., the nominal size, of the piezoelectric ceramic sheet. Thus, unevenness in individual piezoelectric ceramic sheets is inevitably produced in the finished size and the position of each active portion. For example, assuming that the positional difference between active portions of individual piezoelectric ceramic sheets is zero at the center of the lengths of the piezoelectric ceramic sheets, the positional difference increases as the distance of the active portions from the center increases. Therefore, in case of an actuator unit using a relatively large-sized piezoelectric ceramic sheet including a plurality of active portions, when the actuator unit is bonded to a passage unit with being positioned so that an active portion corresponds to a pressure chamber near the center of the length of the actuator unit, the positional difference between an active portion and a pressure chamber may be considerably large near either end of the actuator unit in the length of the actuator unit. As a result, uniform ink ejection performance of the ink jet head may not be obtained. To prevent this, only actuator units each having a finished size near the design size may be used as good products, thereby increasing uniformity in ink ejection performance. In this case, however, because the number of usable actuator units to the population parameter of interest decreases, the manufacture cost remarkably increases.

This problem is not limited to the case wherein an actuator unit includes a piezoelectric ceramic sheet in which active portions are formed by electrodes sandwiching the piezoelectric ceramic sheet. In case that an actuator unit including active portions may have relatively large dimensional error, the same problem may arise irrespective of the construction of the actuator unit.

SUMMARY OF THE INVENTION

An object of the present invention is to provide an ink-jet head capable of increasing uniformity in ink ejection performance with suppressing the decrease in yield of actuator units, and a manufacturing method of the ink-jet head.

According to an aspect of the present invention, an ink-jet head comprises a passage unit including pressure chambers each connected to a nozzle, and an actuator unit bonded to the passage unit. The actuator unit includes active portions for changing volumes of the respective pressure chambers. Kinds of passage units different in positions of pressure chambers distant from a reference position set on a face of each passage unit, are prepared for a single kind of actuator units fabricated in the same design shape with a positional difference between corresponding pressure chambers in the different kinds of passage units increasing as a distance of the pressure chambers from the reference position increases.

According to the invention, because kinds of passage units different in positions of the corresponding pressure chambers are prepared, even when a single kind of actuator units fabricated in the same design size are uneven in the position of each active portion, a passage unit can be selected out of the kinds of passage units for each actuator unit so that the selected passage unit includes pressure chambers with positional differences nearest to the positional differences from the designed positions of the respective active portions of the actuator unit. In addition, because the passage units are fabricated such that the positional differences between the corresponding pressure chambers increases as the distance of the pressure chambers from a reference position set on a face of each passage unit increases, by using one active portion of each actuator unit as a reference and selecting a passage unit in accordance with the positional difference of the active portion, most of the active portions can be positioned to pressure chambers with high accuracy. Therefore, the number of unusable actuator units decreases and thus the yield of actuator units is improved. Further, because the positional difference between the corresponding pressure chamber and active portion decreases, the uniformity of ink ejection performance can be improved.

Here, "different in positions of pressure chambers" means that the corresponding pressure chambers in passage units put on each other do not completely overlap each other. This includes a case wherein the corresponding pressure chambers do not completely overlap each other because the pressure chambers differ in shape from each other, for example.

According to another aspect of the present invention, an ink-jet head comprises a passage unit including slender pressure chambers each connected at its one end to a nozzle. The pressure chambers are arranged along a length of the passage unit with a length of each pressure chamber being substantially parallel to a width of the passage unit. The ink-jet head further comprises an actuator unit comprising a piezoelectric ceramic sheet including active portions for changing volumes of the respective pressure chambers. The active portions are arranged along a length of the actuator unit. Kinds of passage units different in pitch of pressure chambers are prepared for a single kind of actuator units fabricated in the same design shape. The actuator unit is bonded to a passage unit selected out of the kinds of passage units. The selected passage unit includes pressure chambers at pitches substantially equal to pitches of the active portions in the actuator unit.

According to still another aspect of the present invention, an ink-jet head comprises a passage unit including slender pressure chambers each connected at its one end to a nozzle. The pressure chambers are arranged along a length of the passage unit with a length of each pressure chamber being substantially parallel to a width of the passage unit. The ink-jet head further comprises an actuator unit including active portions for changing volumes of the respective pressure chambers. The active portions are arranged along a length of the actuator unit. A substantially central longitudinal axis of each pressure chamber distant from a reference position set on a face of the passage unit is deviated in the direction opposite to the reference position from a straight line extending through both ends of the pressure chamber.

According to still another aspect of the present invention, an ink-jet head comprises a passage unit including slender pressure chambers each connected at its one end to a nozzle. The pressure chambers are arranged along a length of the passage unit with a length of each pressure chamber being substantially parallel to a width of the passage unit. The ink-jet head further comprises an actuator unit including active portions for changing volumes of the respective pressure chambers. The active portions are arranged along a length of the actuator unit. A substantially central longitudinal axis of each pressure chamber distant from a reference position set on a face of the passage unit is deviated toward the reference position from a straight line extending through both ends of the pressure chamber.

According to still another aspect of the present invention, a set of kinds of ink-jet heads have shapes in plane similar to each other. Each ink-jet head comprises a passage unit including slender pressure chambers each connected at its one end to a nozzle. The pressure chambers are arranged along a length of the passage unit with a length of each pressure chamber being substantially parallel to a width of the passage unit. The ink-jet head further comprises an actuator unit comprising a piezoelectric ceramic sheet including active portions for changing volumes of the respective pressure chambers. The active portions are arranged along a length of the actuator unit. A pitch of pressure chambers and a pitch of active portions along the length of the passage unit are substantially equal to each other in any ink-jet head. The pitches of the pressure chambers and the active portions along the length of the passage unit vary from kind to kind of ink-jet heads.

According to still another aspect of the present invention, a manufacturing method of an ink-jet head is provided. The method comprises the steps of fabricating a single kind of actuator units of the same design shape each including active portions; and fabricating kinds of passage units each including pressure chambers each connected to a nozzle. Volumes of the pressure chambers are changeable by actions of the respective active portions of an actuator unit. The kinds of passage units are different from each other in positions of pressure chambers distant from a reference position set on a face of each passage unit with the positional difference between the corresponding pressure chambers of the kinds of passage units increasing as the distance of the pressure chambers from the reference position increases. The method further comprises the steps of taking one out of the actuator units of the single kind; selecting a passage unit of one kind out of the kinds of passage units so that a pitch of pressure chambers of the passage unit of the selected kind is the nearest to a pitch of active portions of the taken actuator unit; and bonding the taken actuator unit to the passage unit of the selected kind.

According to the invention, an ink-jet head in which most of the active portions have been positioned to pressure chambers with high accuracy can be easily manufactured.

According to still another aspect of the present invention, a manufacturing method of an ink-jet head is provided. The method comprises the steps of fabricating a single kind of actuator units of the same design shape each including a piezoelectric ceramic sheet including active portions arranged along a length of the actuator unit; and fabricating kinds of passage units each including slender pressure chambers each connected at its one end to a nozzle. The pressure chambers are arranged along a length of each passage unit with a length of each pressure chamber being substantially parallel to a width of the passage unit. Volumes of the pressure chambers are changeable by actions of the respective active portions of an actuator unit. The kinds of passage units are different from each other in pitch of pressure chambers along the length of each passage unit. The method further comprises the steps of taking one out of the actuator units of the single kind; selecting a passage unit of one kind but of the kinds of passage units so that the pitch of pressure chambers of the passage unit of the selected kind is the nearest to a pitch of active portions of the taken actuator unit; and bonding the taken actuator unit to the passage unit of the selected kind.

In the invention, a value similar to pitch, such as the positional difference between the corresponding two pressure chambers or two active portions, or the whole length of an actuator unit or passage unit, can be used in place of pitch. The invention includes a case using such a value similar to pitch.

BRIEF DESCRIPTION OF THE DRAWINGS

Various exemplary embodiments of the invention will be described in detail with reference to the following figures, wherein.

DESCRIPTION OF THE PREFERRED EMBODIMENTS

Figure 1:
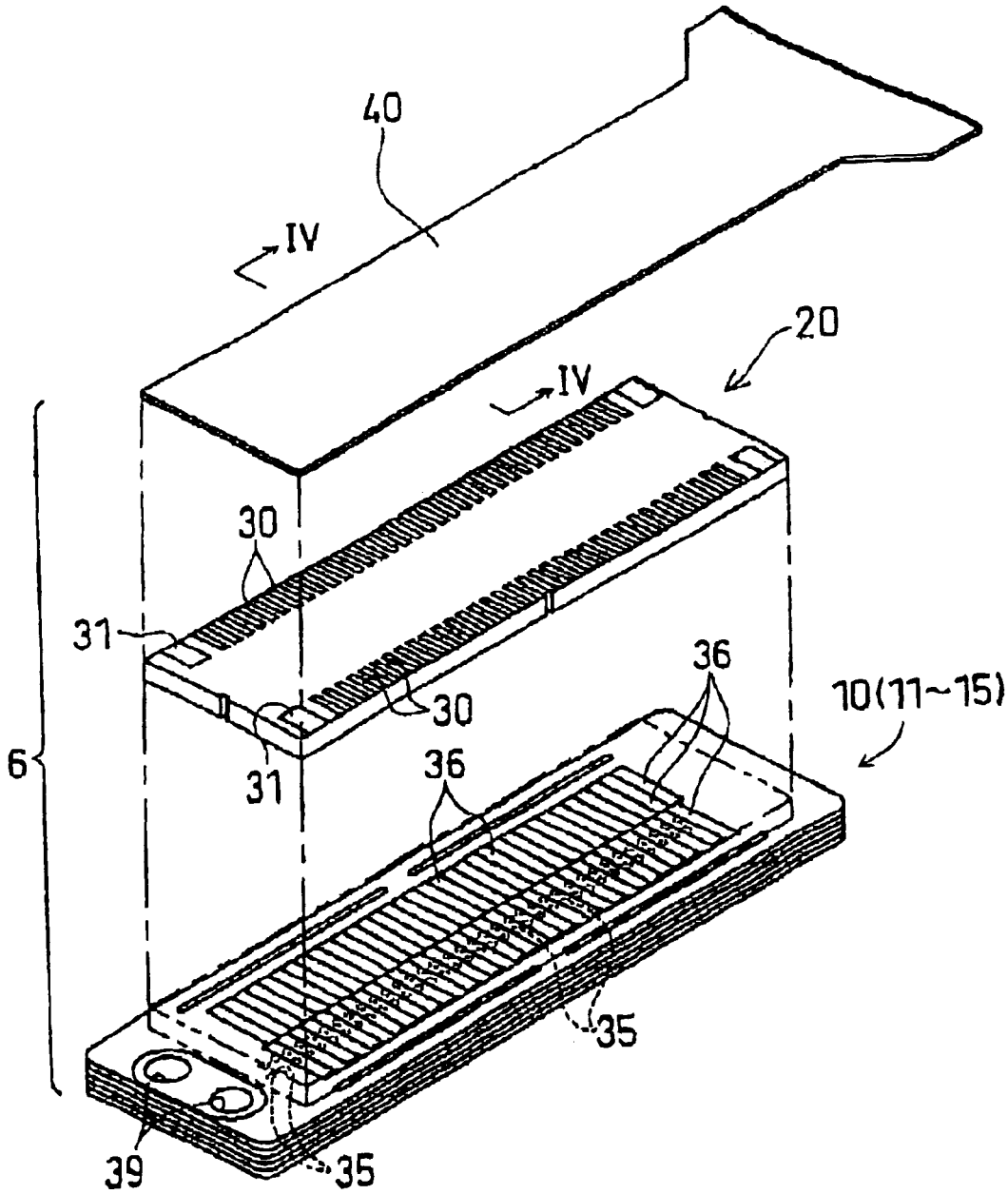
FIG. 1 is a perspective view of an ink-jet head according to an embodiment of the present invention.

FIG. 1 illustrates a perspective view of an ink-jet head 6 according to an embodiment of the present invention. The ink-jet head 6 includes a laminated passage unit 10. A plate-type piezoelectric actuator (hereinafter referred to as actuator unit) 20 is put on and bonded to the passage unit 10 with an adhesive or an adhesive sheet. A flexible flat cable 40 for electrical connection to a driver IC for driving the actuator unit 20 is bonded to the upper face of the actuator unit 20 with an adhesive. The cable 40 is electrically connected to the actuator unit 20. A large number of nozzles 35 are open in the lower face of the passage unit 10. Ink is ejected downward through each nozzle 35.

Figure 2:
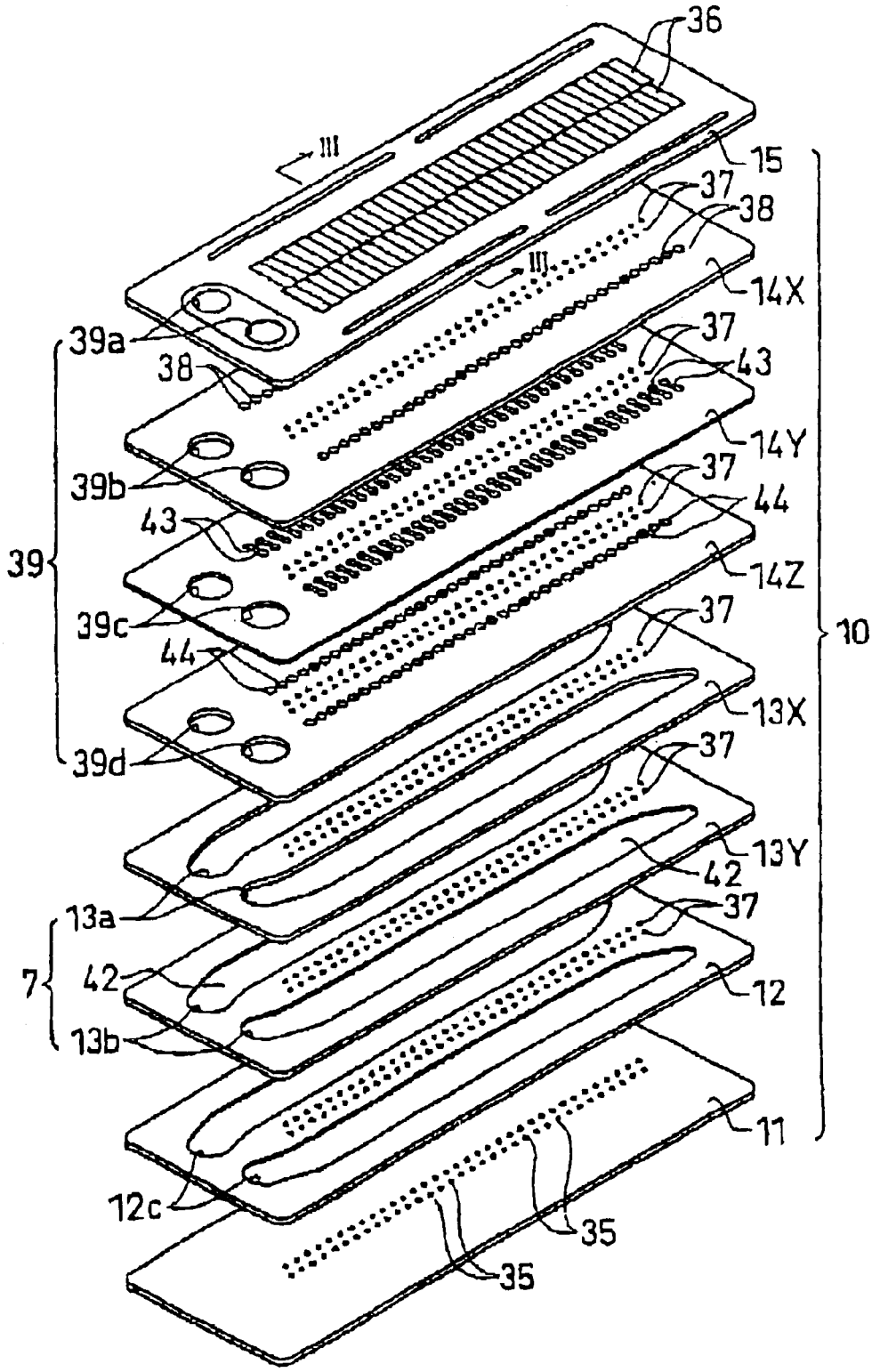
FIG. 2 is an exploded perspective view of a passage unit in the ink-jet head of FIG. 1.
Figure 3:
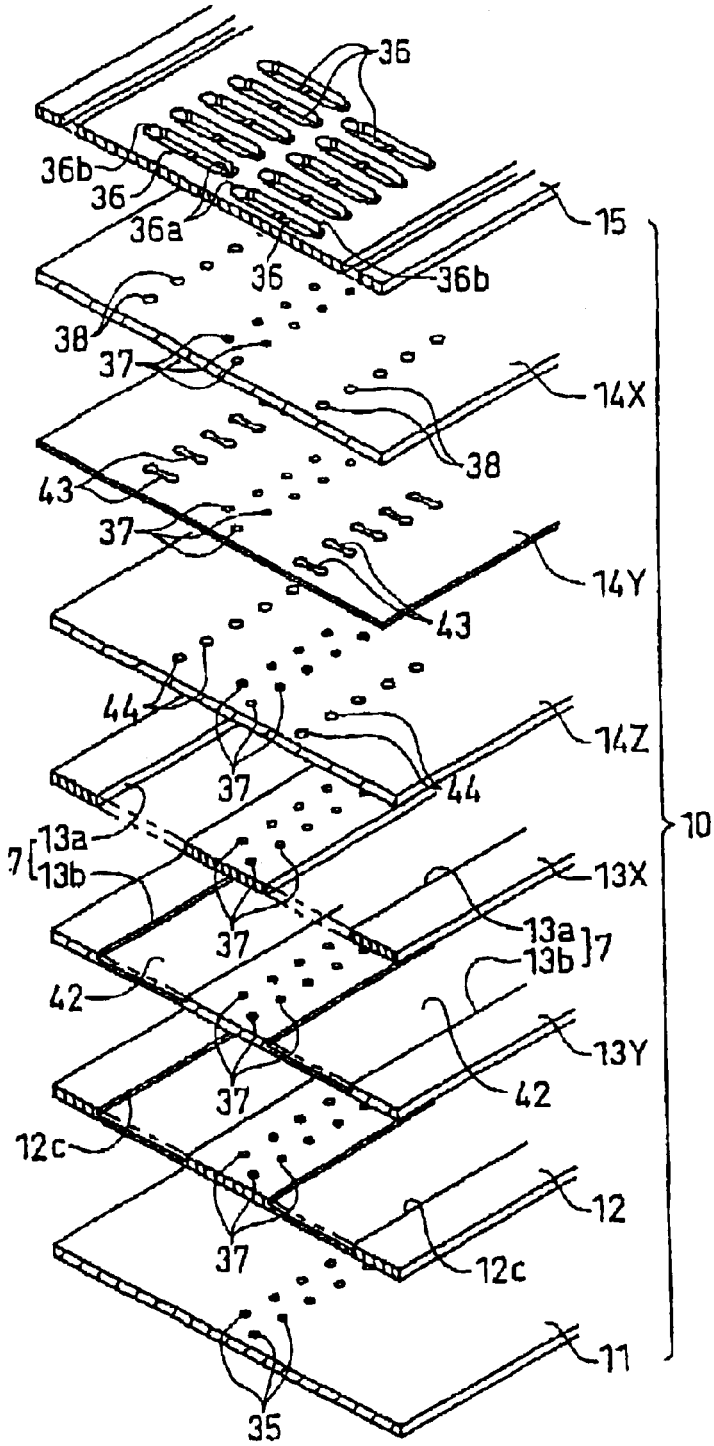
FIG. 3 is a sectional view taken along line III—III in FIG. 2.

FIG. 2 illustrates an exploded perspective view of the passage unit 10. FIG. 3 illustrates an enlarged exploded perspective view of the passage unit 10 in a section taken along line III—III in FIG. 2. As illustrated in FIGS. 2 and 3, the passage unit 10 is made up of eight thin plates, i.e., a nozzle plate 11, a damper plate 12, two manifold plates 13X and 13Y, three spacer plates 14X, 14Y, and 14Z, and a base plate (pressure chamber plate) 15. These eight plates are put in layers and bonded to each other with an adhesive. The nozzle plate 11 is made of a polyimide-base material. The other plates are made of stainless steel.

As illustrated in FIGS. 2 and 3, a large number of nozzles 35 each having a small diameter of, for example, about 25 mm, for ejecting ink are formed in the nozzle plate 11 by pressing or laser processing. The nozzles 35 are arranged at small intervals in two rows in a zigzag manner along the length of the nozzle plate 11.

As illustrated in FIG. 3, a large number of pressure chambers 36 are formed in the base plate 15 in two rows in a zigzag arrangement along the length of the base plate 15. Each pressure chamber 36 is made into a slender shape the length of which is perpendicular to the length of the base plate 15. The pressure chambers 36 are parallel to one another. As will be apparent from the below description, ink flows in each pressure chamber 36 substantially along the length of the pressure chamber 36.

As will be described later, in the ink-jet head 6 of this embodiment, one taken out of a single kind of actuator units 20 of the same design shape is bonded to one selected out of three kinds of passage units though the passage units of the different kinds are denoted by the same reference numeral 10. The three kinds of passage units 10 include three kinds of base plates 15 different in shape, respectively. The other plates constituting each passage unit 10, i.e., the spacer plates 14X, 14Y, and 14Z, the manifold plates 13X and 13Y, the damper plate 12, and the nozzle plate 11, are common to the three kinds of passage units 10. In the below description, the three kinds of base plates 15 may be distinguished from one another by references 15*a* (see FIG. 6), 15*b* (see FIG. 7), and 15*c* (see FIG. 9). That is, this embodiment can include three kinds of ink-jet heads 6 having shapes in plane similar to one another.

Figure 4:
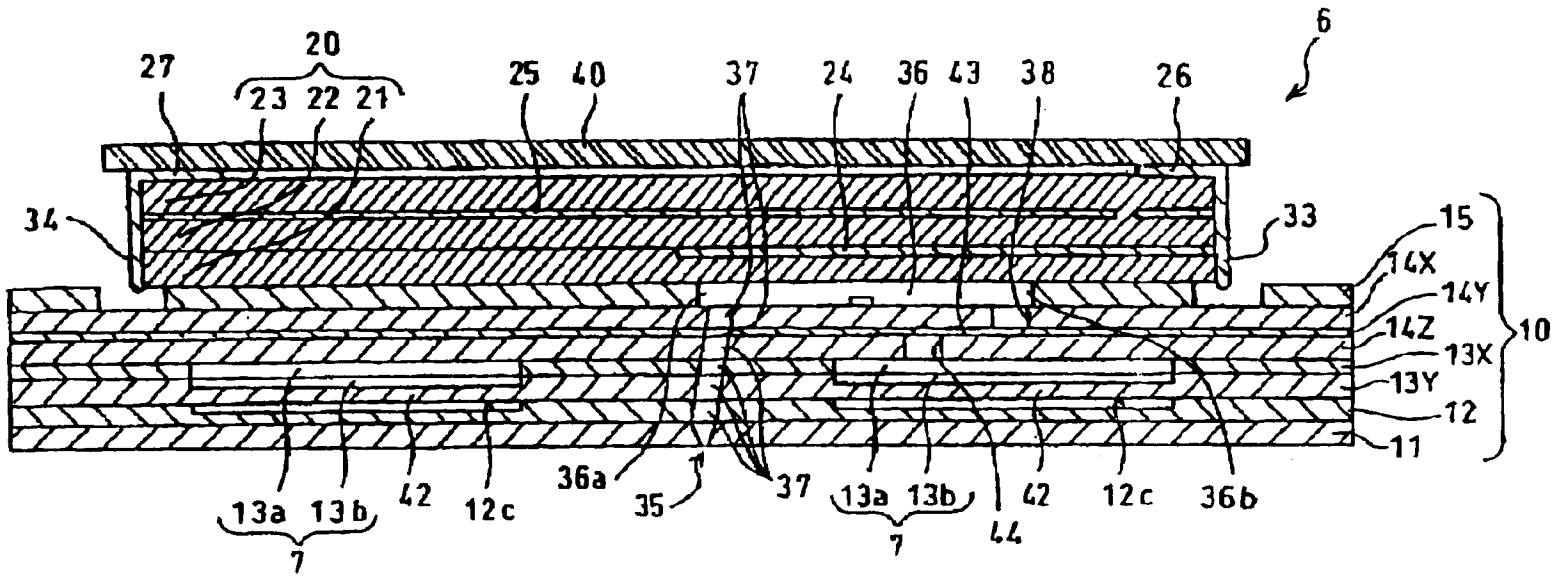
FIG. 4 is an enlarged sectional view taken along line IV—IV in FIG. 1.

As illustrated in FIG. 4, which is an enlarged sectional view taken along line IV—IV in FIG. 1, one end portion 36*a* of each pressure chamber 36 formed in the base plate 15 is connected to a nozzle 35 formed in the nozzle plate 11, through a small-diameter through-hole 37 formed in the three spacer plates 14X, 14Y, and 14Z and the two manifold plates 13X and 13Y, and the damper plate 12. Such through-holes 37 are arranged in a zigzag manner to correspond to the respective arrangements of the pressure chambers and nozzles.

Ink supply holes 38 are formed in the uppermost spacer plate 14X neighboring the base plate 15, to correspond to the respective pressure chambers 36. Each ink supply hole 38 is connected to the other end portion 36*b* of the corresponding pressure chamber 36. Apertures 43 are formed through the thickness of the middle spacer plate 14Y immediately below the uppermost spacer plate 14X. Each throttle portion 43 has a slender shape in the plane of the middle spacer plate 14Y, more specifically, parallel to the length of each pressure chamber 36. Each ink supply hole 38 is connected to one end of the corresponding aperture 43. The other end of each aperture 43 is connected to a manifold channel 7, which will be described later, through an induction hole 44 formed through the thickness of the lowermost spacer plate 14Z. In the ink-jet head 6 according to this embodiment, the sectional area of the flow passage in each aperture 43 is set to a proper value. Thereby, the throttle effect suppresses propagation of pressure variation in ink, which is caused by an operation of the actuator unit 20, toward the manifold channel 7. Thus, efficient ink ejection through each nozzle 35 is realized.

As illustrated in FIG. 2, in the upper manifold plate 13X of the two manifold plates 13X and 13Y nearer to the spacer plates 14X to 14Z, two ink chamber half portions 13*a* are formed through the thickness of the upper manifold plate 13X. In the lower manifold plate 13Y nearer to the nozzle plate 11, two ink chamber half portions 13*b* are provided as recesses facing the upper manifold plate 13X. In this embodiment, the ink chamber half portions 13*a* and 13*b* are formed by etching, in particular, the ink chamber half portions 13*b* are formed by half etching.

When the two manifold plates 13X and 13Y constructed as described above and the lowermost spacer plate 14Z are put in layers, the vertically corresponding ink chamber half portions 13*a* and 13*b* are connected to each other. Thus, two manifold channels 7 are formed on both sides of the rows of the through-holes 37, as illustrated in FIGS. 2 and 4.

In this embodiment, two manifold channels 7 are provided on both sides of the rows of the through-holes 37 so as to correspond to two rows of pressure chambers 36, respectively. That is, the pressure chambers 36 in one row are connected to one manifold channel 7 while the pressure chambers 36 in the other row are connected to the other manifold channel 7. Because the ink-jet head 6 is thus constructed, if the two manifold channels 7 are supplied with inks different in color, printing in two colors can be performed with the single ink-jet head 6. This improves the applicability of the ink-jet head 6 and makes it possible to reduce the number of kinds of parts of the ink-jet head 6. In this embodiment, however, both the manifold channels 7 are supplied with the same color ink to perform printing in monochrome at a high resolution with two rows of nozzles 35.

As illustrated in FIG. 3, damper grooves 12*c* are provided as recesses in the damper plate 12 immediately below the manifold plate 13Y. Each damper groove 12*c* faces the manifold plate 13Y. The damper grooves 12*c* correspond in position and shape to the respective manifold channels 7. Thus, when the manifold plates 13X and 13Y and the damper plate 12 are put in layers, the damper grooves 12*c* are positioned to correspond to the portions of the manifold plate 13Y where the respective ink chamber half portions 13*b* are formed, which portions may be referred to as damper portions 42. Because the manifold plate 13Y is made of a metallic material, e.g., stainless steel, elastically deformable, each damper portion 42 can be easily deformed either toward the corresponding manifold channel 7 or toward the corresponding damper groove 12*c*, and thus the damper portion 42 can freely vibrate. In this structure, even when pressure variation having occurred in a pressure chamber 36 upon ink ejection propagates to the corresponding manifold channel 7, the corresponding damper portion 42 can be elastically deformed and vibrated to damp the pressure variation, which is a damping action. Thereby, cross talk that the pressure variation propagates to another pressure chamber 36 can be prevented.

Referring back to FIG. 2, two ink supply holes 39*a* are formed in the base plate 15. Also, two ink supply holes 39*b*, two ink supply holes 39*c*, and two ink supply holes 39*d* are formed in the spacer plates 14X, 14Y, and 14Z, respectively. When the base plate 15 and the spacer plates 14X, 14Y, and 14Z are put in layers, the corresponding ink supply holes 39*a* to 39*d* are connected to each other to form two ink supply holes 39 corresponding to the respective manifold channels 7 as described above. From the demand of reduction in size of the ink-jet head 6, each ink supply hole 39 is disposed near one end of the corresponding row of pressure chambers 36, and the two ink supply holes 39 are disposed close to each other.

In the passage unit 10 constructed as described above, ink supplied into a manifold channel 7 through the corresponding ink supply hole 39 flows to the other end 30*b* of each pressure chamber 36 through the corresponding induction hole 44, aperture 43, and ink supply hole 38. Ink in each pressure chamber 36 to which ejection energy has been applied by the actuator unit 20 as described later flows from the one end 36*a* of the pressure chamber 36 through the corresponding through-hole 37 to the corresponding nozzle 35, and then the ink is ejected through the nozzle 35.

Figure 5:
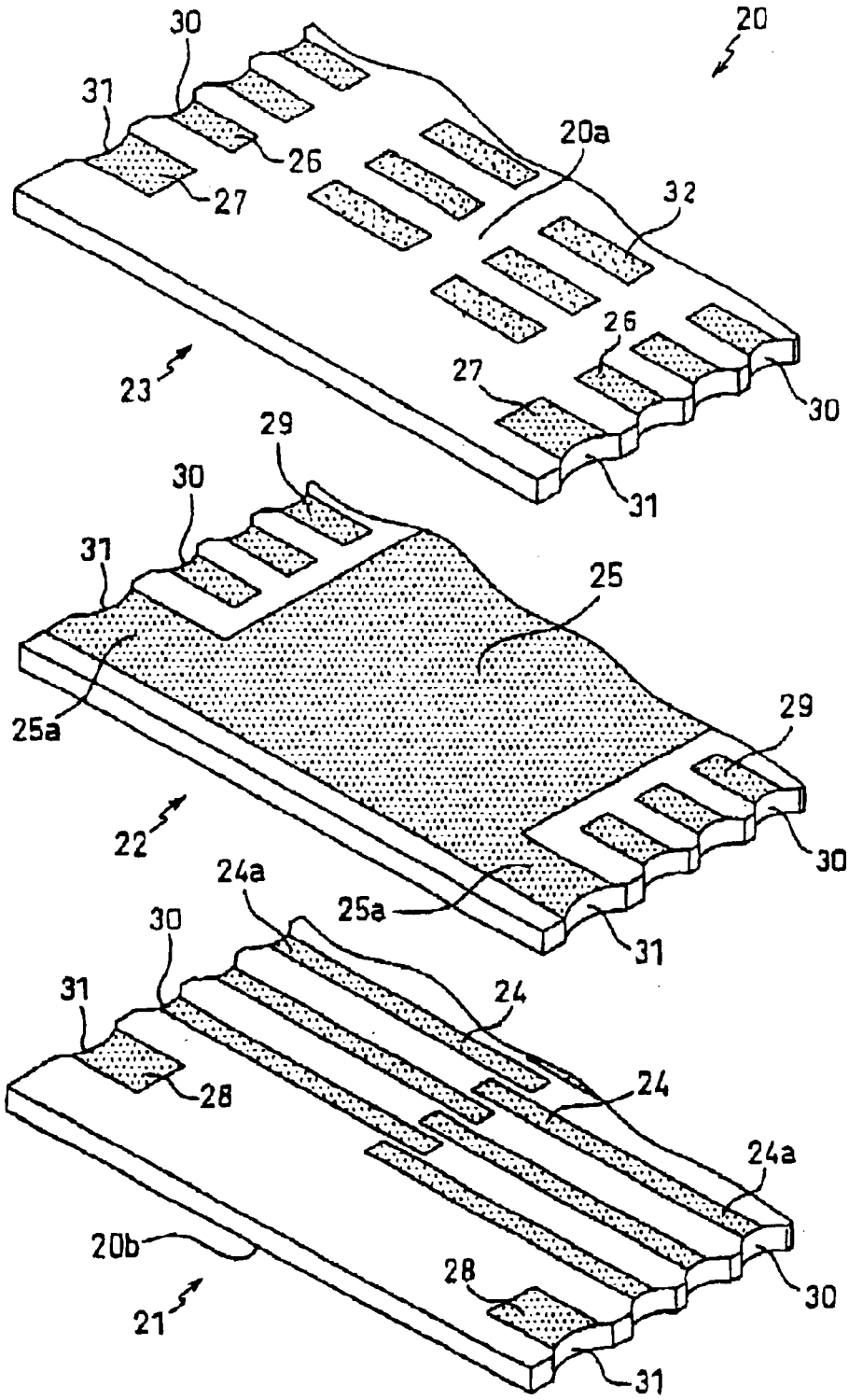
FIG. 5 is an enlarged exploded perspective view of an actuator unit in the ink-jet head of FIG. 1.

Next, the construction of the actuator unit 20 will be described. FIG. 5 illustrates an enlarged exploded perspective view of the actuator unit 20. As illustrated in FIGS. 4 and 5, the actuator unit 20 is laminated with three piezoelectric ceramic sheets (hereinafter simply referred to as piezoelectric sheets) 21, 22, and 23 each made of PZT (lead zirconate titanate).

As apparent from FIG. 1, each of the piezoelectric sheets 21, 22, and 23 has a size extending over a large number of pressure chambers 36 formed in the base plate 15. On the upper face of the lowermost piezoelectric sheet 21, slender individual electrodes 24 are provided in a zigzag arrangement to correspond to the respective pressure chambers 36 in the passage unit 10. One end 24*a* of each individual electrode 24 is exposed from the actuator unit 20 in the left or right face of the actuator unit 20 perpendicular to the upper and lower faces 20*a* and 20*b* of the actuator unit 20.

On the upper face of the middle piezoelectric sheet 22, a common electrode 25 is provided in common to many pressure chambers 36. Like one end 24*a* of each individual electrode 24, ends 25*a* of the common electrode 25 are also exposed from the actuator unit 20 in the left and right faces of the actuator unit 20.

On the upper face of the lowermost piezoelectric sheet 23, surface electrodes 26 corresponding to the respective individual electrodes 24 and surface electrodes 27 corresponding to the common electrode 25 are provided in the left and right regions of the upper face of the lowermost piezoelectric sheet 23. In addition, marks 32 are provided in a central region of the upper face of the lowermost piezoelectric sheet 23 at positions corresponding in plane to the respective individual electrodes 24. The marks 32 are made of the same material as the surface electrodes 26 and 27. The surface electrodes 26 and 27 and the marks 32 are formed by screen printing. The marks 32 are used for indicating the positions of the respective individual electrodes after the piezoelectric sheets 21, 22, and 23 are put in layers and baked. The pitch of the marks 32 measured can be used as the pitch of the individual electrodes 24. In this embodiment, the marks 32 are not used as electrodes. Two or more pairs of piezoelectric sheets 21 and 22 including individual and common electrodes 24 and 25 may be put in layers. The region of the piezoelectric sheet 22 sandwiched by each individual electrode 24 and the common electrode 25 functions as a pressure generation portion, i.e., active portion, for the corresponding pressure chamber 36. Because the uppermost and lowermost sheets 21 and 23 suffer no piezoelectric effect, they need not be made of piezoelectric materials. However, use of the same material as that of the piezoelectric sheet 22 is convenient for manufacture.

In the left and right faces of the actuator unit 20, first concave grooves 30 corresponding to the one ends 24*a* of the respective individual electrodes 24 and second concave grooves 31 corresponding to the ends 25*a* of the common electrode 25 are formed to extend along the lamination of the actuator unit 20. A side electrode 33 (see FIG. 4) is provided in each first concave groove 30 to electrically connect the corresponding individual and surface electrodes 24 and 26 to each other. Also, a side electrode 34 (see FIG. 4) is provided in each second concave groove 31 to electrically connect the common and surface electrodes 25 and 27 to each other. Electrodes denoted by references 28 and 29 are dummy-pattern electrodes.

The passage unit 10 and the actuator unit 20 are put in layers such that the pressure chambers 36 in the passage unit 10 correspond to the respective individual electrodes 24 in the actuator unit 20. Further, various patterns (not illustrated) on the flexible flat cable 40 are electrically connected to the surface electrodes 26 and 27 on the upper face 20*a* of the actuator unit 20.

When a voltage is applied between an arbitrarily selected individual electrode 24 and the common electrode 25 of the actuator unit 20 of the ink-jet head 6, strain is generated along the lamination of the actuator unit 20 by the piezoelectric effect in the active portion of the piezoelectric sheet 22 corresponding to the individual electrode 24 to which the voltage has been applied. Thereby, the volume of the corresponding pressure chamber 36 reduces. Ejection energy is thus applied to ink in the pressure chamber 36. The ink is then ejected in droplets through the corresponding nozzle 35 to print a predetermined image on a paper.

Next, the construction of the passage unit 10 in the ink-jet head 6 according to this embodiment will be described with reference to FIGS. 6 to 10. As described above, three kinds of passage units 10 different only in the base plate 15 are prepared for the ink-jet head 6 of this embodiment. The three kinds of base plates 15 are denoted by references 15*a*, 15*b*, and 15*c*, respectively. This is because each actuator unit 20 is laminated with piezoelectric sheets and the actuator units 20 may be uneven in finished size after baking process even though they had the same design size. Therefore, after baking process, the actuator units 20 are classified into three ranks by the difference of the finished size from the design size, and then each actuator unit 20 is bonded to a passage unit 10 of one kind in accordance with the rank of the actuator unit 20.

Figure 6:
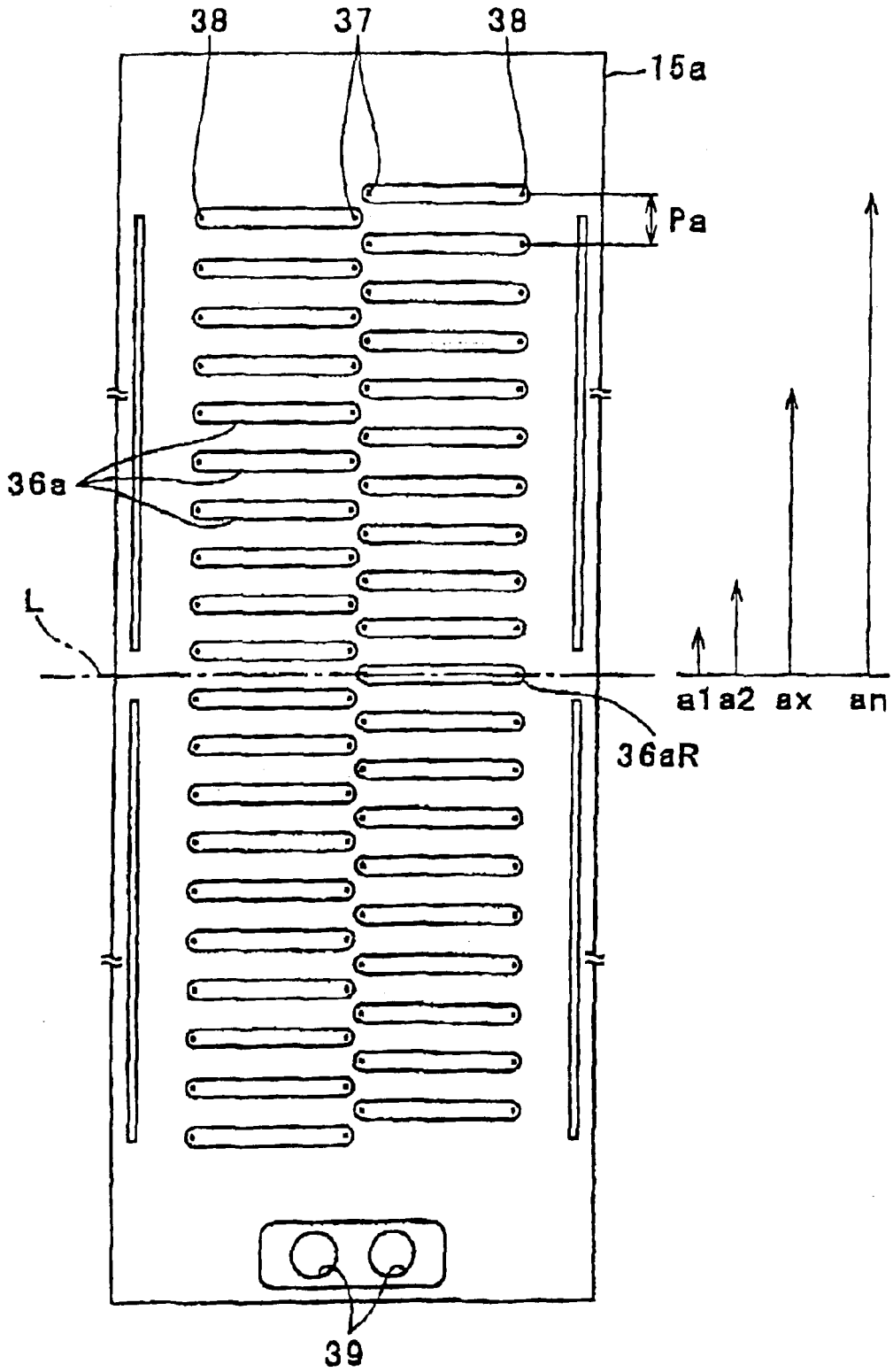
FIG. 6 is a plan view of a base plate for the passage unit of FIG. 2.
Figure 7:
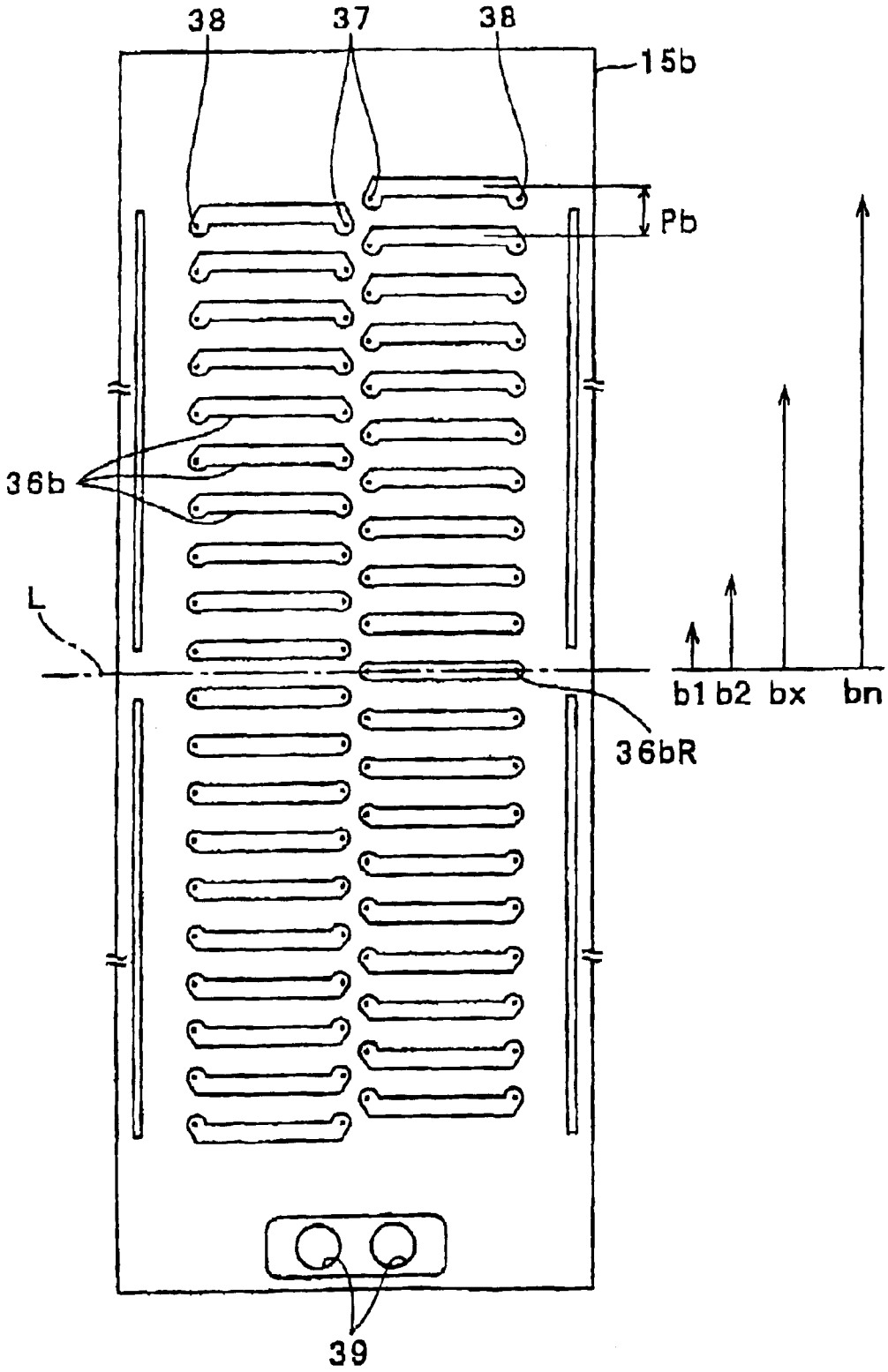
FIG. 7 is a plan view of a base plate of a kind different from that of FIG. 6, for the passage unit of FIG. 2.
Figure 8:
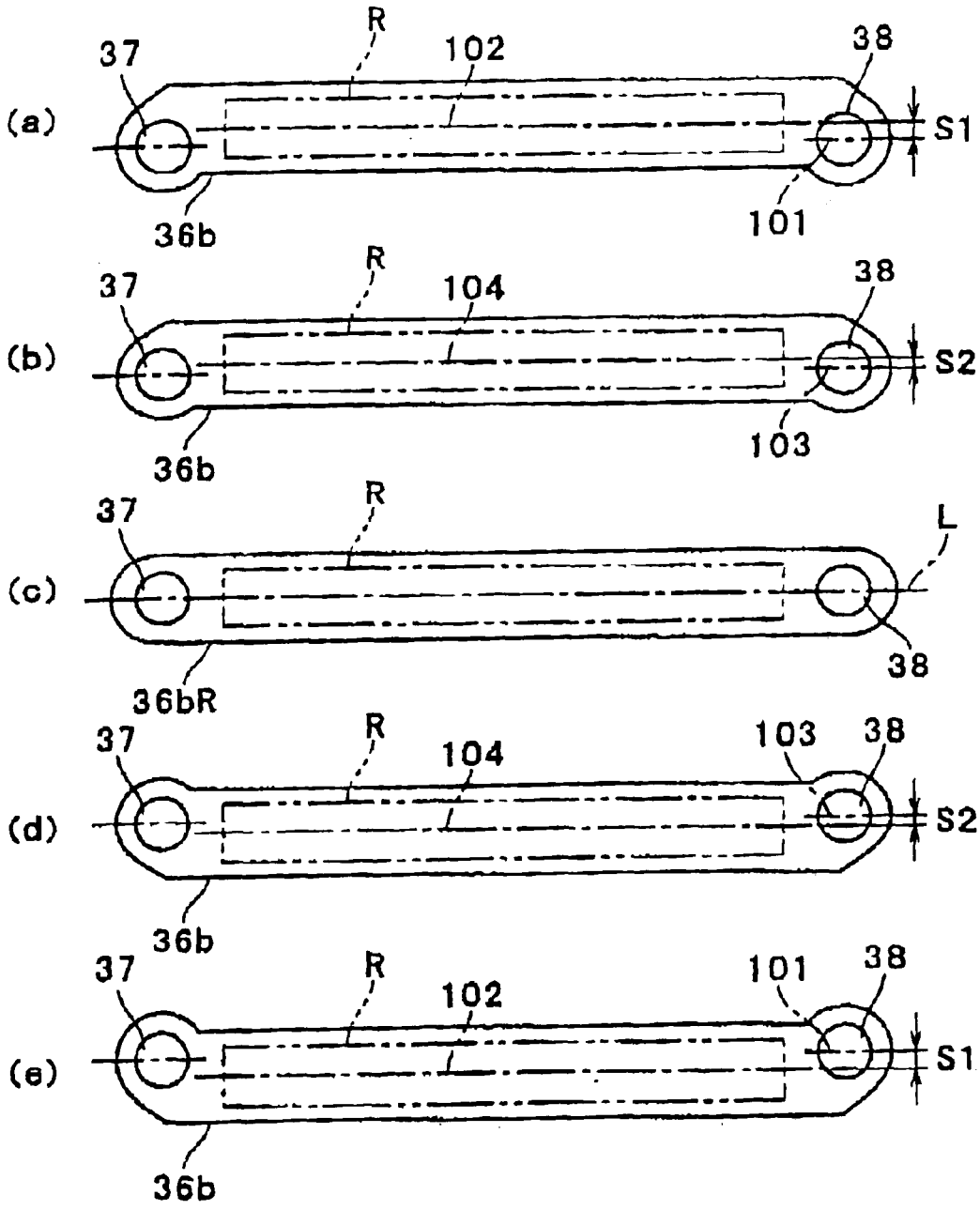
FIGS. 8(*a*) to (*e*) are enlarged views of pressure chambers formed in the base plate of FIG. 7.
Figure 9:
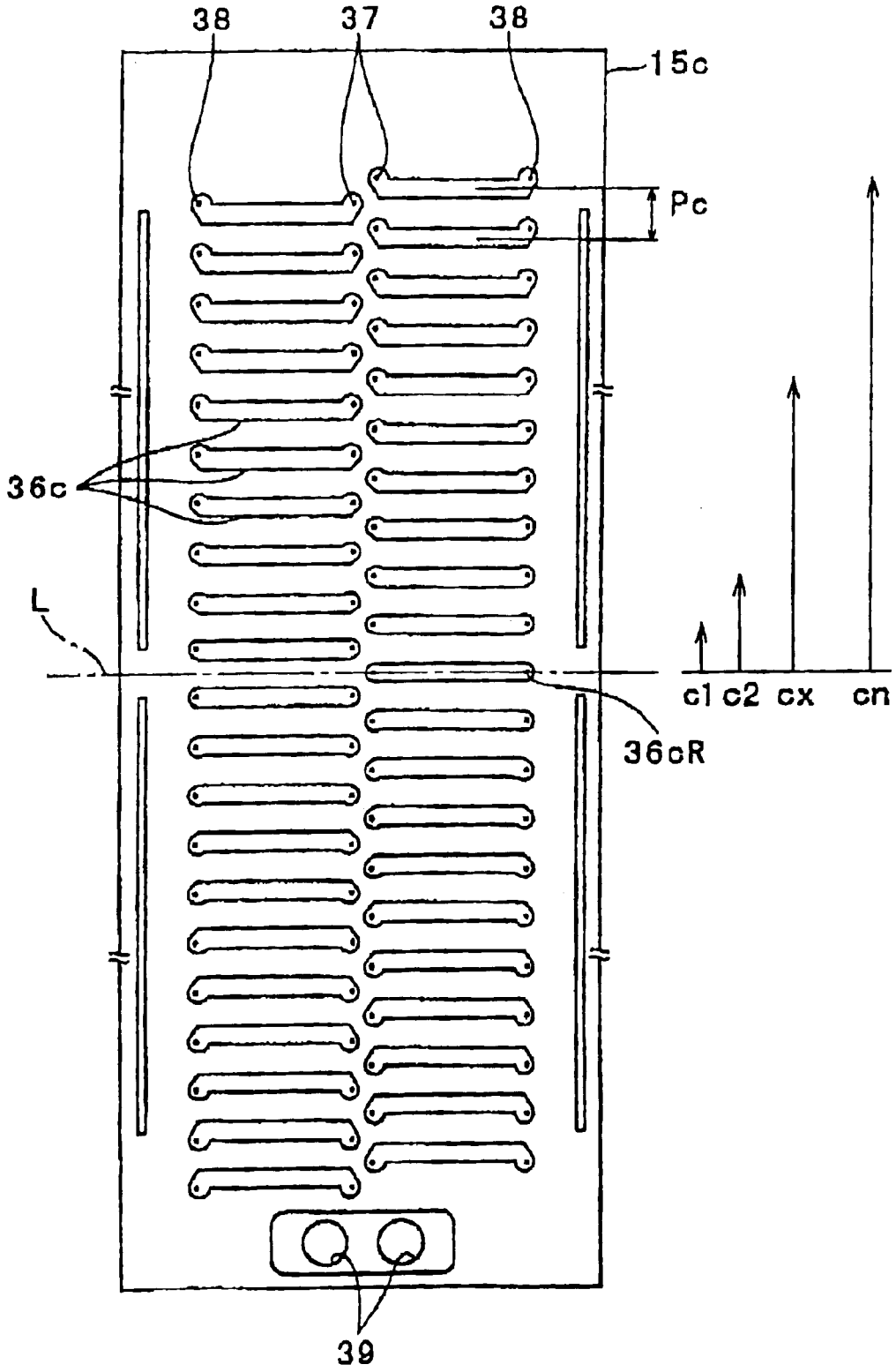
FIG. 9 is a plan view of a base plate of a kind different from those of FIGS. 6 and 7, for the passage unit of FIG. 2.
Figure 10:
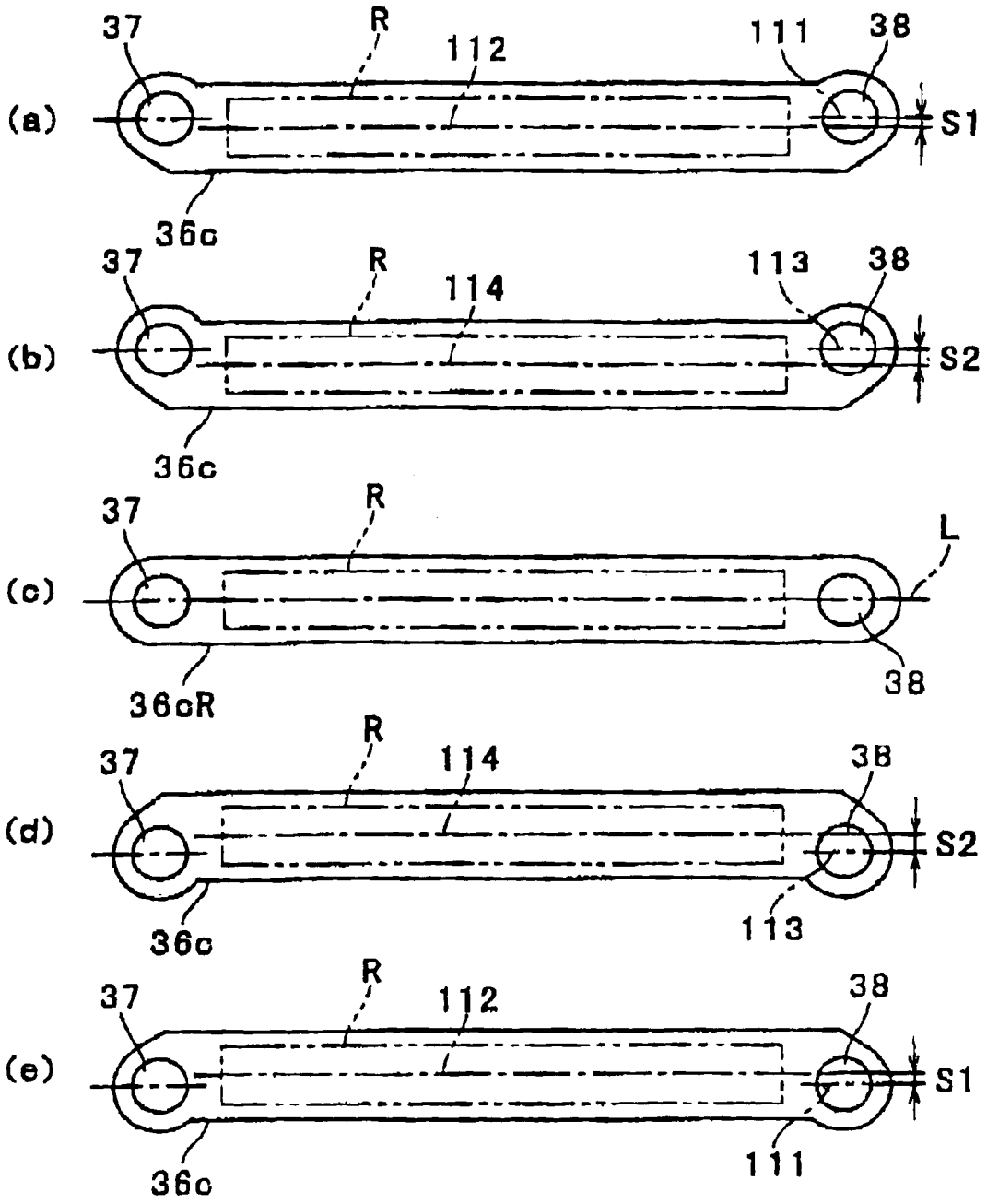
FIGS. 10(*a*) to (*e*) are enlarged views of pressure chambers formed in the base plate of FIG. 9.

FIGS. 6, 7, and 9 illustrate plan views of three different kinds of base plates, respectively. FIGS. 8(*a*) to (*e*) illustrate enlarged views of pressure chambers formed in the base plate of FIG. 7. FIGS. 10(*a*) to (*e*) illustrate enlarged views of pressure chambers formed in the base plate of FIG. 9.

In a base plate 15*a* of FIG. 6, each pressure chamber, denoted by reference 36*a*, has an elongated circular shape along the width of the base plate 15*a*. Both ends of each pressure chamber 36*a* where a through-hole 37 and an ink supply hole 38 are exposed, i.e., the positions of the connecting portions, are on a longitudinal axis of the pressure chamber 36*a* central in the width of the pressure chamber 36*a*, i.e., an ink flow center line.

In the below description, the distance from the ink flow center line L of the pressure chamber 36*a*R near the center of the length of the base plate 15*a*, to the ink flow center line of a pressure chamber 36*a* neighboring the pressure chamber 36*a*R, is represented by a1. Also, the distances from the ink flow center line L of the pressure chamber 36*a*R to the ink flow center lines of a pressure chamber 36*a* distant by two pressure chambers from the pressure chamber 36*a*R, a pressure chamber 36*a* distant by x pressure chambers (x: a natural number) from the pressure chamber 36*a*R, and a pressure chamber 36*a* most distant, i.e., by n pressure chambers (n: a natural number), from the pressure chamber 36*a*R, are represented by a2, ax, and an, respectively.

Because all the pressure chambers 36*a* formed in the base plate 15*a* have the same shape, they have substantially the same volume Va. Further, the pitch of pressure chambers 36*a* formed in the base plate 15*a*, such as a2-a1 and a3-a2, is constant as Pa in any region of the base plate 15*a*.

In a base plate 15*b* of FIG. 7, a pressure chamber 36*b*R near the center of the length of the base plate 15*b* has an elongated circular shape along the width of the base plate 15*b*, like each pressure chamber 36*a* of FIG. 6. Both ends of the pressure chamber 36*b*R, where a through-hole 37 and an ink supply hole 38 are exposed, i.e., the positions of the connecting portions, are on the ink flow center line of the pressure chamber 36*b*R. FIG. 8(*c*) illustrates an enlarged plan view of the pressure chamber 36*b*R. In FIGS. 8(*a*) to (*e*) and 10(*a*) to (*e*), each region enclosed by an alternating long and two dashes line and denoted by reference R represents an active portion vertically sandwiched by individual and common electrodes 24 and 25.

Each pressure chamber 36*b* of the base plate 15*b* other than the pressure chamber 36*b*R has its connecting portions of both ends, where a through-hole 37 and an ink supply hole 38 are exposed, at their regular positions, and the middle portion of the pressure chamber 36*b* is deviated outward, i.e., in the direction opposite to the pressure chamber 36*b*R. That is, each pressure chamber 36*b* other than the pressure chamber 36*b*R has a concave shape facing inward. The deviation in the pressure chamber 36*b* increases as the distance of the pressure chamber 36*b* from the pressure chamber 36*b*R increases.

For example, FIGS. 8(*a*) and (*e*) illustrate enlarged plan views of the respective pressure chambers 36*b* most distant from the pressure chamber 36*b*R. In this case, the ink flow center line 102 of either pressure chamber 36*b* is deviated outward in the arrangement of pressure chambers 36*b*, i.e., along the length of the passage unit 10, by a distance S1 from both end positions (connecting portions) 101 of the pressure chamber 36*b* where a through-hole 37 and an ink supply hole 38 are exposed. FIGS. 8(*b*) and (*d*) illustrate enlarged plan views of pressure chambers 36*b* near the centers of the respective ranges between the pressure chamber 36*b*R and the pressure chambers 36*b* most distant from the pressure chamber 36*b*R. In this case, the ink flow center line 104 of either pressure chamber 36*b* is deviated outward in the arrangement of pressure chambers 36*b* by a distance S2 (S2<S1) from both end positions (connecting portions) 103 of the pressure chamber 36*b* where a through-hole 37 and an ink supply hole 38 are exposed. Both end positions 101 or 103 of each pressure chamber 36*b*, where a through-hole 37 and an ink supply hole 38 are exposed, are the same as those of the corresponding pressure chamber 36*a* in the base plate 15*a* of FIG. 6. In the base plate 15*b* of FIG. 7, therefore, the ink flow center line 102 of either pressure chamber 36*b* most distant from the pressure chamber 36*b*R is deviated outward by the distance S1 from the ink flow center line of the corresponding pressure chamber 36*a* in the base plate 15*a* of FIG. 6. Also, the ink flow center line 104 of either pressure chamber 36*b* near the center of the range between the pressure chamber 36*b*R and the pressure chamber 36*b* most distant from the pressure chamber 36*b*R, is deviated outward by the distance S2 from the ink flow center line of the corresponding pressure chamber 36*a* in the base plate 15*a* of FIG. 6.

Now, the distances from the ink flow center line L of the pressure chamber 36*b*R near the center of the length of the base plate 15*b* to the ink flow center lines of the pressure chamber 36*b* neighboring the pressure chamber 36*b*R, the pressure chamber 36*b* distant by two pressure chambers from the pressure chamber 36*b*R, the pressure chamber 36*b* distant by x pressure chambers (x: a natural number) from the pressure chamber 36*b*R, and the pressure chamber 36*b* most distant, i.e., by n pressure chambers (n: a natural number), from the pressure chamber 36*b*R, are represented by b1, b2, bx, and bn, respectively. In this case, relations of bx>ax (x=1, 2, . . . , n) and bn−an> . . . >b2−a2>b1−a1, are obtained. That is, comparing the corresponding pressure chambers 36*a* and 36*b* of the two base plates 15*a* and 15*b* with each other, the distance from the central pressure chamber 36*b*R to another pressure chamber 36*b* is larger than the distance from the central pressure chamber 36*a*R to the pressure chamber 36*a* corresponding to the pressure chamber 36*b*, and the difference of the pressure chamber 36*b* from the corresponding pressure chamber 36*a* increases as the distance of the pressure chamber 36*b* from the central pressure chamber 36*b*R increases.

The pitch of pressure chambers 36*b* formed in the base plate 15*b* is constant as Pb, nearly equal to Pa+α, in any region of the base plate 15*b*, where α is a value set upon designing. Thus, the pitch of pressure chambers 36*b* is somewhat larger than the pitch of pressure chambers 36*a*.

As described above, in the base plate 15*b*, the pressure chambers 36*b* vary in shape in accordance with the distances from the pressure chamber 36*b*R. If no measure is taken, the volume Vb of the pressure chamber 36*b* increases as the distance from the pressure chamber 36*b*R increases. In this embodiment, however, the shape of each pressure chamber 36*b* has been adjusted so that the volume Vb of any pressure chamber 36*b* is substantially equal to the volume Va of the pressure chamber 36*a*. In order to ensure each active portion R to be included in the corresponding pressure chamber 36*b* with a sufficient margin, the adjustment in shape is preferably implemented by, e.g., decreasing the size of each pressure chamber 36*b* not in a longitudinally middle portion of the pressure chamber 36*b* but near both ends of the pressure chamber 36*b*.

In a base plate 15*c* of FIG. 9, a pressure chamber 36*c*R near the center of the length of the base plate 15*c* has an elongated circular shape along the width of the base plate 15*c*, like each pressure chamber 36*a* of FIG. 6. Both ends of the pressure chamber 36*c*R, where a through-hole 37 and an ink supply hole 38 are exposed, are on the ink flow center line of the pressure chamber 36*c*R. FIG. 10(*c*) illustrates an enlarged plan view of the pressure chamber 36*c*R.

Each pressure chamber 36*c* of the base plate 15*c* other than the pressure chamber 36*c*R has its connecting portions of both ends, where a through-hole 37 and an ink supply hole 38 are exposed, at their regular positions, and the middle portion of the pressure chamber 36*c* is deviated inward, i.e., toward the pressure chamber 36*c*R. That is, each pressure chamber 36*c* other than the pressure chamber 36*c*R has a concave shape facing outward. The deviation in the pressure chamber 36*c* increases as the distance of the pressure chamber 36*c* from the pressure chamber 36*c*R increases.

For example, FIGS. 10(*a*) and (*e*) illustrate enlarged plan views of the respective pressure chambers 36*c* most distant from the pressure chamber 36*c*R. In this case, the ink flow center line 112 of either pressure chamber 36*c* is deviated inward in the arrangement of pressure chambers 36*c*, i.e., along the length of the passage unit 10, by a distance S1 from both end positions (connecting portions) 111 of the pressure chamber 36*c* where a through-hole 37 and an ink supply hole 38 are exposed. FIGS. 10(*b*) and (*d*) illustrate enlarged plan views of pressure chambers 36*c* near the centers of the respective ranges between the pressure chamber 36*c*R and the pressure chambers 36*c* most distant from the pressure chamber 36*c*R. In this case, the ink flow center line 114 of either pressure chamber 36*c* is deviated inward in the arrangement of pressure chambers 36*c* by a distance S2 (S2<S1) from both end positions (connecting portions) 113 of the pressure chamber 36*c* where a through-hole 37 and an ink supply hole 38 are exposed. Both end positions 111 or 113 of each pressure chamber 36*c*, where a through-hole 37 and an ink supply hole 38 are exposed, are the same as those of the corresponding pressure chamber 36*a* in the base plate 15*a* of FIG. 6. In the base plate 15*c* of FIG. 9, therefore, the ink flow center line 112 of either pressure chamber 36*c* most distant from the pressure chamber 36*c*R is deviated inward by the distance S1 from the ink flow center line of the corresponding pressure chamber 36*a* in the base plate 15*a* of FIG. 6. Also, the ink flow center line 114 of either pressure chamber 36*c* near the center of the range between the pressure chamber 36*c*R and the pressure chamber 36*c* most distant from the pressure chamber 36*c*R, is deviated inward by the distance S2 from the ink flow center line of the corresponding pressure chamber 36*a* in the base plate 15*a* of FIG. 6.

Now, the distances from the ink flow center line L of the pressure chamber 36*c*R near the center of the length of the base plate 15*c* to the ink flow center lines of the pressure chamber 36*c* neighboring the pressure chamber 36*c*R, the pressure chamber 36*c* distant by two pressure chambers from the pressure chamber 36*c*R, the pressure chamber 36*c* distant by x pressure chambers (x: a natural number) from the pressure chamber 36*c*R, and the pressure chamber 36*c* most distant, i.e., by n pressure chambers (n: a natural number), from the pressure chamber 36*c*R, are represented by c1, c2, cx, and cn, respectively. In this case, relations of ax>cx (x=1, 2, . . . , n) and an−cn> . . . >a2−c2>a1−c1, are obtained. That is, comparing the corresponding pressure chambers 36*a* and 36*c* of the two base plates 15*a* and 15*c* with each other, the distance from the central pressure chamber 36*c*R to another pressure chamber 36*c* is larger than the distance from the central pressure chamber 36*a*R to the pressure chamber 36*a* corresponding to the pressure chamber 36*c*, and the difference of the pressure chamber 36*c* from the corresponding pressure chamber 36*a* increases as the distance of the pressure chamber 36*c* from the central pressure chamber 36*c*R increases.

The pitch of pressure chambers 36*c* formed in the base plate 15*c* is constant as Pc, nearly equal to Pa−α, in any region of the base plate 15*c*. Thus, the pitch of pressure chambers 36*c* is somewhat smaller than the pitch of pressure chambers 36*a*.

As described above, in the base plate 15*c*, the pressure chambers 36*c* vary in shape in accordance with the distances from the pressure chamber 36*c*R. If no measure is taken, the volume Vc of the pressure chamber 36*c* increases as the distance from the pressure chamber 36*c*R increases. In this embodiment, however, the shape of each pressure chamber 36*c* has been adjusted so that the volume Vc of any pressure chamber 36*c* is substantially equal to the volume Va of the pressure chamber 36*a*. In order to ensure each active portion R to be included in the corresponding pressure chamber 36*c* with a sufficient margin, the adjustment in shape is preferably implemented by, e.g., decreasing the size of each pressure chamber 36*c* not in a longitudinally middle portion of the pressure chamber 36*c* but near both ends of the pressure chamber 36*c*.

As apparent from the above description, as a relation among the distances of the corresponding pressure chambers 36*a*, 36*b*, and 36*c* of the three kinds of base plates 15*a*, 15*b*, and 15*c* from the ink flow center line L common to the three kinds of base plates 15*a*, 15*b*, and 15*c*, bx>ax>cx (x=1, 2, . . . , n) is obtained. Further, as a relation in the positional differences between the corresponding pressure chambers of the three kinds of base plates 15*a*, 15*b*, and 15*c*, (an−cn)≈(bn−an)> . . . >(a2−c2)≈(b2−a2)>(a1−c1)≈(b1−a1) is obtained. That is, comparing the corresponding pressure chambers 36*a*, 36*b*, and 36*c* of the three kinds of base plates 15*a*, 15*b*, and 15*c* with one another, the distance of the pressure chamber 36*b* from the central pressure chamber is the largest, the distance of the pressure chamber 36*a*from the central pressure chamber is the second largest, and the distance of the pressure chamber 36*c* from the central pressure chamber is the smallest. The positional difference between the corresponding pressure chambers increases as the distance of the pressure chambers from the common ink flow center line L increases.

As described above, the three kinds of passage units 10 different in positions of the corresponding pressure chambers are prepared for the ink-jet head 6 of this embodiment. Therefore, even when a single kind of actuator units 20 fabricated in the same design size are uneven in positions of active portions, one passage unit 10 can be selected for each actuator unit 20 out of the three kinds of passage units 10 so that the selected passage unit 10 includes pressure chambers 36 having the positional differences nearest to the positional differences from the designed positions of the active portions of the actuator unit 20. Thus, most of the active portions, i.e., regions R, are positioned to the corresponding pressure chambers 36 with high accuracy. As a result, even an actuator unit 20 that was conventionally unusable due to its large difference from the design size becomes usable. Thereby, the yield of actuator units can be improved and thus the manufacture cost of ink-jet heads can be reduced. Further, because the positional difference of each pressure chamber 36 from the corresponding active portion can be small, the uniformity of ink ejection performance can be improved.

In this embodiment, three kinds of base plates 15 may only be prepared and the other plates 11 to 14 may be common to the three kinds of passage units 10. This can simplify the manufacture process and realize a reduction of manufacture cost.

Further, in this embodiment, the ink flow center line 101 or 104 or 112 or 114 of each pressure chamber 36*b* or 36*c* is deviated from both end positions 101 or 103 or 111 or 113 of the pressure chamber 36*b* or 36*c*, where a through-hole 37 and an ink supply hole 38 are exposed, i.e., the positions of the connecting portions. Therefore, only by a relatively easy design change, for example, by changing the quantity of the deviation, the three kinds of passage units 10 can be prepared.

Further, the ink-jet head 6 of this embodiment has an advantage that an actuator unit 20 including active portions can be realized by a relatively simple structure in which individual electrodes 24 and a common electrode 25 sandwiching a piezoelectric sheet 22 having a size extending over a plurality of pressure chambers are disposed at positions corresponding to the respective pressure chambers.

In addition, in this embodiment, the three kinds of passage units 10 are designed such that the volumes Va, Vb, and Vc of the pressure chambers 36*a*, 36*b*, and 36*c* are substantially the same. Therefore, there is no difference in ink ejection amount between the pressure chambers 36. This decreases the difference in area between ink dots and realizes a very good quality of a printed image.

Figure 11:
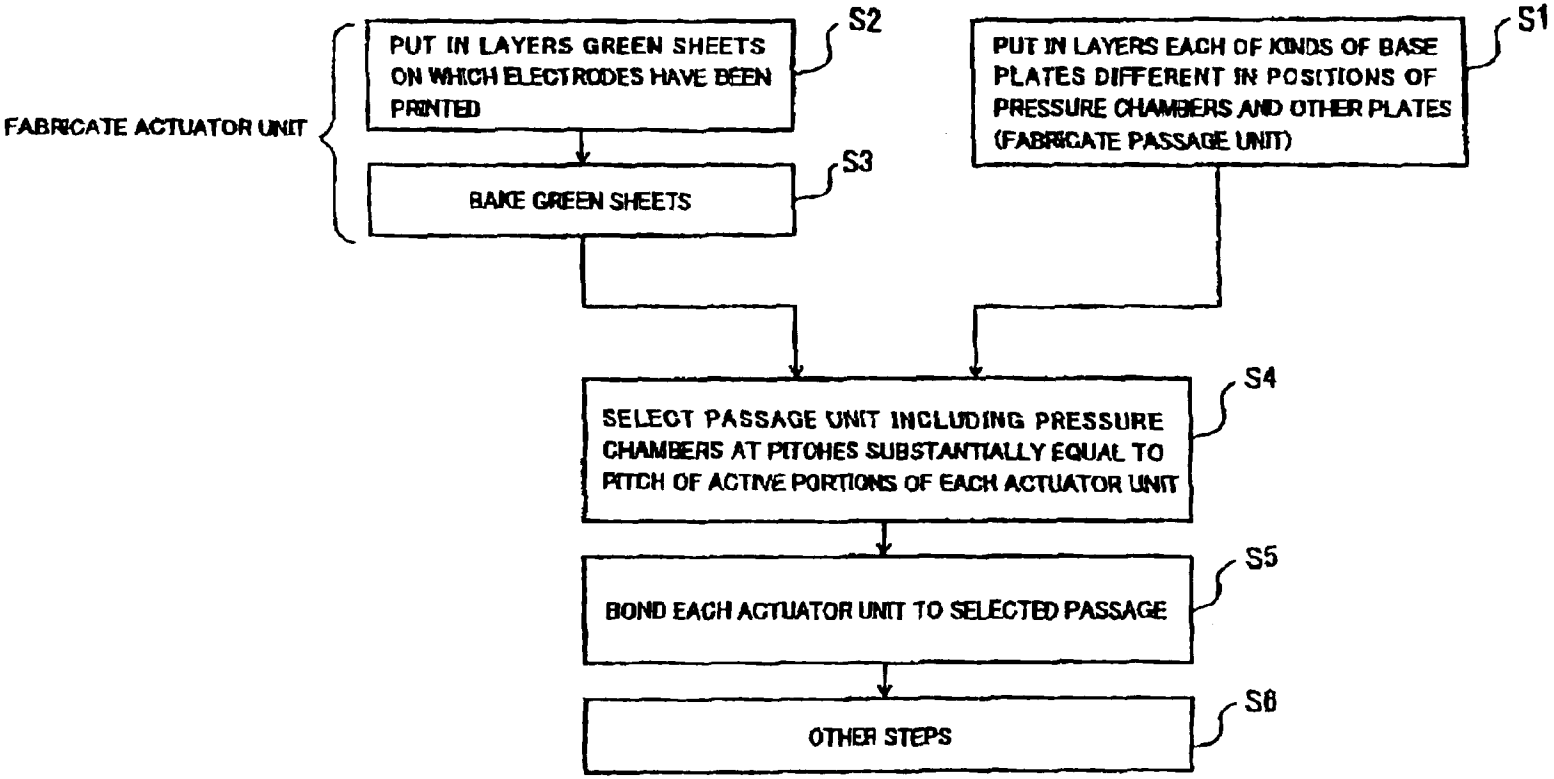
FIG. 11 is a flowchart of a manufacturing method of an ink-jet head according to an embodiment of the present invention.

Next, an outline of a manufacturing method of an ink-jet head according to this embodiment will be described with reference to a flowchart of FIG. 11. To manufacture an ink-jet head 6, parts such as a passage unit 10 and an actuator unit 20 are fabricated separately and then the parts are assembled into the ink-jet head 6.

To fabricate a passage unit 10, eight plates 11, 12, 13X, 13Y, 14X, 14Y, 14Z, and 15 as illustrated in FIG. 2 are put in layers and then bonded to each other with an adhesive. In this embodiment, only for the base plate 15, three kinds of base plates 15 different in shape of pressure chamber 36 are prepared. For each of the other plates 11, 12, 13X, 13Y, 14X, 14Y, and 14Z, only one kind is prepared. Therefore, three kinds of passage units 10 different in base plate 15 and common in the other plates are fabricated. This is performed in Step 1.

To fabricate an actuator unit 20, first, individual electrodes 24, a common electrode 25, surface electrodes 26 and 27, and marks 32 each made of a conductive paste are formed by screen printing on green sheets each made of a piezoelectric ceramic. A green sheet on which the individual electrodes 24 have been printed and a green sheet on which the common electrode 25 has been printed are then alternately put in layers. On the layered structure, a green sheet on which the surface electrodes 26 and 27 and the marks 32 have been printed is further put. This is performed in Step 2.

The laminated body obtained in Step 2 is then degreased like known ceramics and baked at a predetermined temperature. This is performed in Step 3. Through the above process, an actuator unit 20 as illustrated in FIG. 5 can be relatively easily fabricated. Unlike the passage units 10, only a single kind of actuator units 20 of the same design shape are fabricated. Although the pitches of the electrodes and each green sheet are designed with taking account of shrinkage upon baking, because the shrinkage may vary in quantity, the finished size may be larger or smaller than the design size.

Next, the pitch of individual electrodes 24 is measured using the marks 32 on each actuator unit 20. Based on the measured pitch, actuator units 20 are classified into three ranks different in finished size range. In this embodiment, actuator units 20 in which the difference between the finished size and the design size is less than a predetermined value are classified into rank a. Actuator unit 20 in which the finished size is larger than the design size and the difference between the finished size and the design size is not less than the predetermined value are classified into rank b. Actuator unit 20 in which the finished size is smaller than the design size and the difference between the finished size and the design size is not less than the predetermined value are classified into rank c. As a passage unit to be bonded to an actuator unit of rank a, a passage unit 10 including the base plate 15*a* (pitch Pa) of FIG. 6 is selected. As a passage unit to be bonded to an actuator unit of rank b, a passage unit 10 including the base plate 15*b* (pitch Pb) of FIG. 7 is selected. As a passage unit to be bonded to an actuator unit of rank c, a passage unit 10 including the base plate 15*c* (pitch Pc) of FIG. 10 is selected. This is performed in Step 4.

In this embodiment, the passage unit and the actuator unit are paired based on the pitches of active portions and pressure chambers. However, a similar value such as the whole length of the actuator unit 20 or base plate 15 can be used in place of the pitches.

Afterward, each actuator unit 20 is bonded to the passage unit 10 selected for the actuator unit 20, with an adhesive with positioning between active portions and pressure chambers 36. This is performed in Step 5. At this time, the actuator unit 20 is preferably bonded to the passage unit 10 such that the active portion near the center of the length of the actuator unit 20 and the pressure chamber 36 near the center of the length of the passage unit 10 are accurately positioned to each other. Thereby, all pressure chambers 36 can be positioned to the respective active portions. Afterward, other steps such as a step of bonding a flexible flat cable 40 to the actuator unit 20 are carried out to complete an ink-jet head 6 according to this embodiment. Those steps are represented in the lump by Step 6.

By this manufacturing method, the ink-jet head 6 of the above-described embodiment can be easily manufactured.

In the above-described embodiment, three kinds of passage units 10 are prepared. However, the number of kinds of passage units may be two, four, or more. In accordance with the number of kinds of passage units, actuator units 20 may be classified into the same number of ranks as the passage units.

In an ink-jet head of the present invention, the passage unit may not always be constituted by plural plates. In addition, pressure chambers may not be arranged in two rows in a zigzag manner as in the above-described embodiment. The arrangement of pressure chambers can be freely modified. Further, the structure of the actuator unit is not limited to one in which a piezoelectric sheet is sandwiched by electrodes. Any known structure can be used if the actuator unit bonded to a passage unit can change the volume of each pressure chamber of the passage unit.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting, Various changes may be made without departing from the spirit and scope of the invention as defined in the following claims.

What is claimed is:

1. An ink-jet head comprising:

a passage unit including a plurality of pressure chambers each connected to a nozzle; and an actuator unit bonded to the passage unit, the actuator unit including a plurality of active portions for changing volumes of the respective pressure chambers, a plurality of kinds of passage units different in positions of pressure chambers distant from a reference position set on a face of each passage unit, being prepared for a single kind of actuator units fabricated in the same design shape with a positional difference between corresponding pressure chambers in the different kinds of passage units increasing as a distance of the pressure chambers from the reference position increases.

2. The ink-jet head according to claim 1, wherein the passage unit comprises a plurality of plates including one or more base plates in which pressure chambers are formed, the plurality of kinds of passage units are different from each other in positions of pressure chambers formed in the one or more base plates, and the remaining plate or plates are common to all kinds of passage units.

3. The ink-jet head according to claim 2, wherein the plurality of pressure chambers are arranged perpendicularly to a flow direction of ink in each pressure chamber so that ink flows in the same direction in pressure chambers, each pressure chamber is provided at its one end in the flow direction of ink with a connection portion connected to a passage in the remaining plate or plates, and in at least one of the plurality of kinds of passage units, each pressure chamber near an end of a row of the plurality of pressure chambers has a portion corresponding to an active portion of the actuator unit, deviated along an arrangement of the plurality of pressure chambers relatively to the connection portion of the pressure chamber.

4. The ink-jet head according to claim 1, wherein the actuator unit comprises:

a piezoelectric ceramic sheet having a size to extend over the plurality of pressure chambers;

a common electrode disposed on one face of the piezoelectric ceramic sheet to be common to pressure chambers; and individual electrodes disposed on the other face of the piezoelectric ceramic sheet at positions corresponding to the respective pressure chambers, each individual electrode cooperating with the common electrode to sandwich the piezoelectric ceramic sheet.

5. The ink-jet head according to claim 4, wherein marks for indicating positions of the respective individual electrodes are provided on a face of the actuator unit other than the piezoelectric ceramic sheet sandwiched by the common electrode and the individual electrodes.

6. The ink-jet head according to claim 1, wherein the passage unit was fabricated such that every pressure chamber has substantially the same volume irrespective of the kind of the passage unit.

7. An ink-jet head comprising:

a passage unit including a plurality of slender pressure chambers each connected at its one end to a nozzle, the plurality of pressure chambers being arranged along a length of the passage unit with a length of each pressure chamber being substantially parallel to a width of the passage unit; and an actuator unit comprising a piezoelectric ceramic sheet including a plurality of active portions for changing volumes of the respective pressure chambers, the plurality of active portions being arranged along a length of the actuator unit, a plurality of kinds of passage units different in pitch of pressure chambers being prepared for a single kind of actuator units fabricated in the same design shape, the actuator unit being bonded to a passage unit selected out of the plurality of kinds of passage units, the selected passage unit including pressure chambers at pitches substantially equal to pitches of the active portions in the actuator unit.

8. An ink-jet head comprising:

a passage unit including a plurality of slender pressure chambers each connected at its one end to a nozzle, the plurality of pressure chambers being arranged along a length of the passage unit with a length of each pressure chamber being substantially parallel to a width of the passage unit; and an actuator unit including a plurality of active portions for changing volumes of the respective pressure chambers, the plurality of active portions being arranged along a length of the actuator unit, a substantially central longitudinal axis of each pressure chamber distant from a reference position set on a face of the passage unit being deviated in the direction opposite to the reference position from a straight line extending through both ends of the pressure chamber.

9. The ink-jet head according to claim 8, wherein the deviation of the axis of the pressure chamber increases as the distance of the pressure chamber from the reference position increases.

10. An ink-jet head comprising:

a passage unit including a plurality of slender pressure chambers each connected at its one end to a nozzle, the plurality of pressure chambers being arranged along a length of the passage unit with a length of each pressure chamber being substantially parallel to a width of the passage unit; and an actuator unit including a plurality of active portions for changing volumes of the respective pressure chambers, the plurality of active portions being arranged along a length of the actuator unit, a substantially central longitudinal axis of each pressure chamber distant from a reference position set on a face of the passage unit being deviated toward the reference position from a straight line extending through both ends of the pressure chamber.

11. The ink-jet head according to claim 10, wherein the deviation of the axis of the pressure chamber increases as the distance of the pressure chamber from the reference position increases.

12. A set of a plurality of kinds of ink-jet heads having shapes in plane similar to each other, each ink-jet head comprising:

a passage unit including a plurality of slender pressure chambers each connected at its one end to a nozzle, the plurality of pressure chambers being arranged along a length of the passage unit with a length or each pressure chamber being substantially parallel to a width of the passage unit; and an actuator unit comprising a piezoelectric ceramic sheet including a plurality of active portions for changing volumes of the respective pressure chambers, the plurality of active portions being arranged along a length of the actuator unit, a pitch of pressure chambers and a pitch of active portions along the length of the passage unit being substantially equal to each other in any ink-jet head, the pitches of the pressure chambers and the active portions along the length of the passage unit varying from kind to kind of ink-jet heads.

13. A manufacturing method of an ink-jet head, the method comprising the steps of:

fabricating a single kind of actuator units of the same design shape each including a plurality of active portions;

fabricating a plurality of kinds of passage units each including a plurality of pressure chambers each connected to a nozzle, volumes of the pressure chambers being changeable by actions of the respective active portions of an actuator unit, the plurality of kinds of passage units being different from each other in positions of pressure chambers distant from a reference position set on a face of each passage unit with the positional difference between the corresponding pressure chambers of the plurality of kinds of passage units increasing as the distance of the pressure chambers from the reference position increases;

taking one out of the actuator units of the single kind;

selecting a passage unit of one kind out of the plurality of kinds of passage units so that a pitch of pressure chambers of the passage unit of the selected kind is the nearest to a pitch of active portions of the taken actuator unit; and bonding the taken actuator unit to the passage unit of the selected kind.

14. The method according to claim 13, wherein the step of fabricating the single kind of actuator units comprises the steps of:

forming, for each actuator unit, a common electrode common to pressure chambers on one face of a piezoelectric ceramic green sheet having a size to extend over the plurality of pressure chambers, and forming individual electrodes on the other face of the green sheet at positions corresponding to the respective pressure chambers; and baking the green sheet sandwiched by the common electrode and the individual electrodes.

15. The method according to claim 14, wherein the step of fabricating the single kind of actuator units further comprises the step of:

forming marks for indicating positions of the respective individual electrodes, on a face of each actuator unit other than the green sheet sandwiched by the common electrode and the individual electrodes.

16. A manufacturing method of an ink-jet head, the method comprising the steps of:

fabricating a single kind of actuator units of the same design shape each including a piezoelectric ceramic sheet including a plurality of active portions arranged along a length of the actuator unit;

fabricating a plurality of kinds of passage units each including a plurality of slender pressure chambers each connected at its one end to a nozzle, the plurality of pressure chambers being arranged along a length of each passage unit with a length of each pressure chamber being substantially parallel to a width of the passage unit, volumes of the pressure chambers being changeable by actions of the respective active portions of an actuator unit, the plurality of kinds of passage units being different from each other in pitch of pressure chambers along the length of each passage unit;

taking one out of the actuator units of the single kind;

selecting a passage unit of one kind out of the plurality of kinds of passage units so that the pitch of pressure chambers of the passage unit of the selected kind is the nearest to a pitch of active portions of the taken actuator unit; and bonding the taken actuator unit to the passage unit of the selected kind.

17. An ink-jet head comprising a passage unit including a plurality of pressure chambers each connected to a nozzle, and an actuator unit bonded to the passage unit, the actuator unit including active portions for changing volumes of the respective pressure chambers, the ink-jet head being manufactured through a process comprising the steps of:

fabricating a single kind of actuator units of the same design shape each including a plurality of active portions;

fabricating a plurality of kinds of passage units each including a plurality of pressure chambers each connected to a nozzle, the plurality of kinds of passage units being different from each other in positions of pressure chambers distant from a reference position set on a face of each passage unit with the positional difference between the corresponding pressure chambers of the plurality of kinds of passage units increasing as the distance of the pressure chambers from the reference position increases;

taking one out of the actuator units of the single kind;

selecting a passage unit of one kind out of the plurality of kinds of passage units so that a pitch of pressure chambers of the passage unit of the selected kind is the nearest to a pitch of active portions of the taken actuator unit; and bonding the taken actuator unit to the passage unit of the selected kind.

* * * * *